United States Patent [19]

Cupp et al.

[11] 4,205,411

[45] Jun. 3, 1980

[54] UNIVERSAL PAINT TRAY

[75] Inventors: Charles D. Cupp; Frederick J. Wood, Jr., both of Lancaster, N.Y.

[73] Assignee: Shur-Line Manufacturing Co., Inc., Lancaster, N.Y.

[21] Appl. No.: 16,510

[22] Filed: Mar. 1, 1979

[51] Int. Cl.[2] ..... B44D 3/12; B65D 25/32

[52] U.S. Cl. ..... 15/257.06; 220/96; 248/210

[58] Field of Search ..... 15/257.05, 257.06; 248/210, 211, 302, 303; 220/95, 96, 341

[56] References Cited

U.S. PATENT DOCUMENTS

| | | | |
|---|---|---|---|
| 2,444,056 | 6/1948 | McCarl | 220/95 X |
| 2,851,187 | 9/1958 | Hall | 220/96 X |
| 3,139,188 | 6/1964 | Goetz et al. | 15/257.06 X |
| 3,304,034 | 2/1967 | Jones | 206/408 X |
| 3,641,616 | 2/1972 | Bonci | 15/257.06 |
| 3,648,322 | 3/1972 | Meisner | 15/104.92 X |
| 3,731,840 | 5/1973 | Beutler et al. | 15/257.06 X |
| 3,804,290 | 4/1974 | Billman | 220/96 X |

FOREIGN PATENT DOCUMENTS

| | | | |
|---|---|---|---|
| 653256 | 12/1962 | Canada | 15/257.06 |

*Primary Examiner*—Philip R. Coe

*Attorney, Agent, or Firm*—Sommer & Sommer

[57] ABSTRACT

An improved tray assembly broadly includes a tray and a bail. The tray has a bottom and a pair of spaced side walls. An outer wall is spaced from each side wall, and is provided with an opening spaced laterally from the tray's center of gravity. Distal end portions of the bail are inserted into the openings to mount the bail for pivotal movement relative to the tray between a raised position and a lowered position. A stop member engages the bail in its raised position to prevent further pivotal movement thereof in one angular direction. An abutment member engages the bail in its lowered position to prevent further pivotal movement thereof in the opposite angular direction. If desired, the tray assembly may further include a roller having stub shafts extending axially outwardly from either end face. These stub shafts may be journalled in trunnion bearings mounted on the tray. Each trunnion bearing preferably has a narrowed entrance portion dimensioned less than the diameter of the stub shafts so that the roller may be snapped into the trunnion bearings.

9 Claims, 12 Drawing Figures

UNIVERSAL PAINT TRAY

BACKGROUND OF THE INVENTION

1. Field of the Invention

The present invention relates generally to the field of paint trays and the like, and more particularly to an improved tray assembly which is particularly suited for use as a painter's caddy.

2. Description of the Prior Art

Many forms of paint trays are, of course known.

However, upon information and belief, many known paint trays are limited by a lack of universality of possible uses.

One example of a known form of paint tray, containing a metering roller, is representatively shown in U.S. Pat. No. 3,648,322. However, this type of tray construction appears to be limited practically to use with pad-type paint applicators, and does not appear to be readily suited for use with brush and roller-type applicators. Additionally, this known tray appears to be difficult to hold while painting, and does not appear to facilitate ready relocation of the tray, particularly when working on a ladder.

SUMMARY OF THE INVENTION

The present invention provides an improved tray assembly which is particularly suited for use as a painter's caddy.

Broadly, the improved tray assembly includes: a tray having a bottom and a pair of spaced side walls; mounting means on each of the side walls and severally providing an opening spaced laterally from the tray's center of gravity; a bail having two marginal end portions inserted into the mounting means openings, the bail being pivotally mounted on the tray for movement in one angular direction toward a raised position and for movement in the opposite angular direction toward a lowered position; and stop means mounted on the tray and arranged to engage a portion of the bail when the bail is in its raised position to prevent further pivotal movement of the bail relative to the tray in said one angular direction.

The preferred embodiment further includes abutment means mounted on the tray and adapted to engage the bail when the bail is in its lowered position to prevent further pivotal movement of the bail relative to the tray in said opposite angular direction. The bail may include at least one hook portion adapted to engage a rung or shelf of a ladder, and the underside of the tray may be provided with a plurality of sawtooth-like notches arranged to face the bail, when the bail is in its lowered position, for use in capturing an object therebetween.

The improved tray may be further provided with a pair of trunnion bearings mounted on the side walls and arranged to face one another, and the tray assembly may include a roller having stub shafts extending axially beyond its end faces. Preferably, each trunnion bearing has a narrowed entrance portion, the width of which is slightly less than the diameter of the stub shafts, so that the roller may be snapped into the trunnion bearings.

Accordingly, one general object of the present invention is to provide an improved tray assembly which is adapted to many uses.

Another object is to provide an improved tray assembly which may accommodate brush, roller and pad-type applicators.

Another object is to provide improved trunnion bearings for use in a tray assembly, which bearings will prevent unintended separation of a roller from a tray.

Still another object is to provide a universal paint tray which may be rested on a plannar object, carried by the painter, or easily mounted on a ladder.

These and other objects will become apparent from the foregoing and ongoing specification, the drawings, and the appended claims.

DESCRIPTION OF THE PREFERRED EMBODIMENTS

Figure 1:
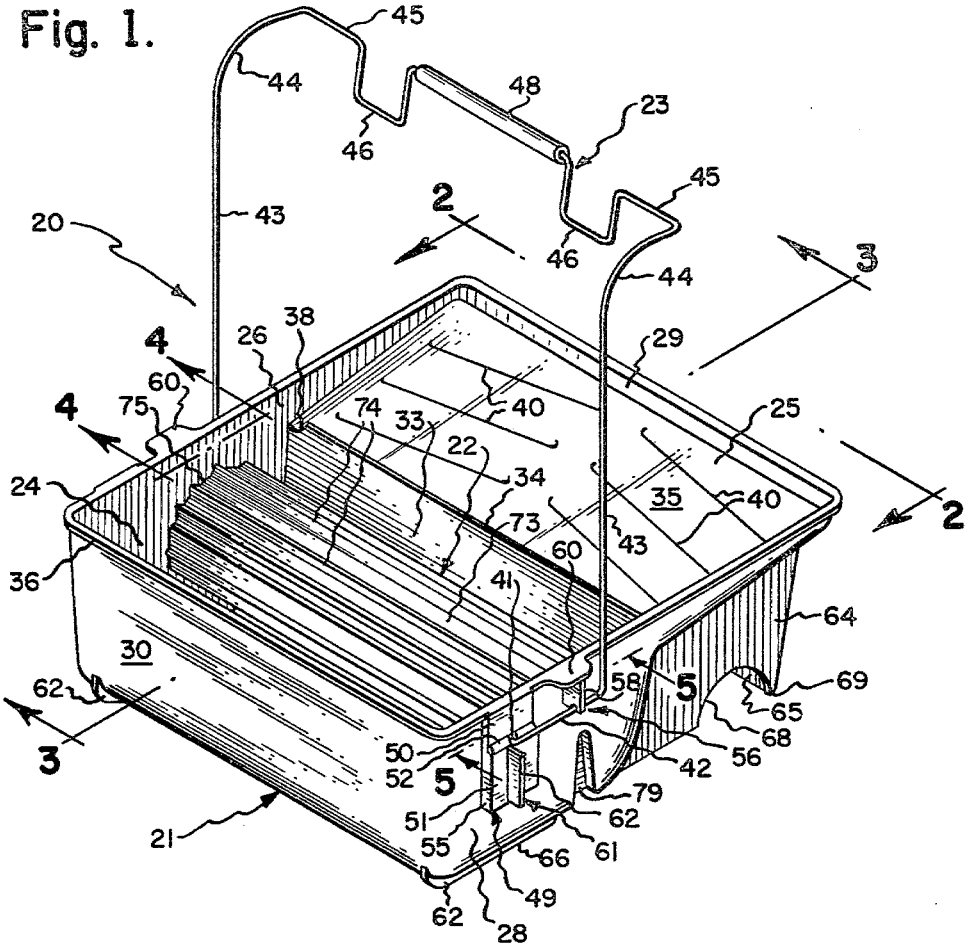
FIG. 1 is a perspective view looking at the right rear corner of the improved tray assembly, this view particularly showing the tray, bail and roller, the stop means and the abutment means.

At the outset, it should be clearly understood that like reference numerals are intended to identify the same elements and/or structure consistently throughout the several drawing figures, as such elements and/or structure may be further described or explained by the entire written specification of which this detailed description is an integral part.

Referring now to the drawings, and more particularly to FIG. 1 thereof, the presently preferred embodiment of the improved tray assembly is generally indicated at 20, and is particularly suited for use as a painter's caddy or the like.

The improved tray assembly 20 is shown as broadly including a tray 21, a roller 22 freely journalled on the tray, and a bail 23 which is uniquely shaped to cooperate with portions or surfaces on the tray to increase the adaptability of the tray assembly to multiple uses. Before proceeding, it should be pointed out that the improved tray assembly may be used with brush, roller or pad-type applicators for applying a liquid coating, such as paint, to a suitable object.

Figure 2:
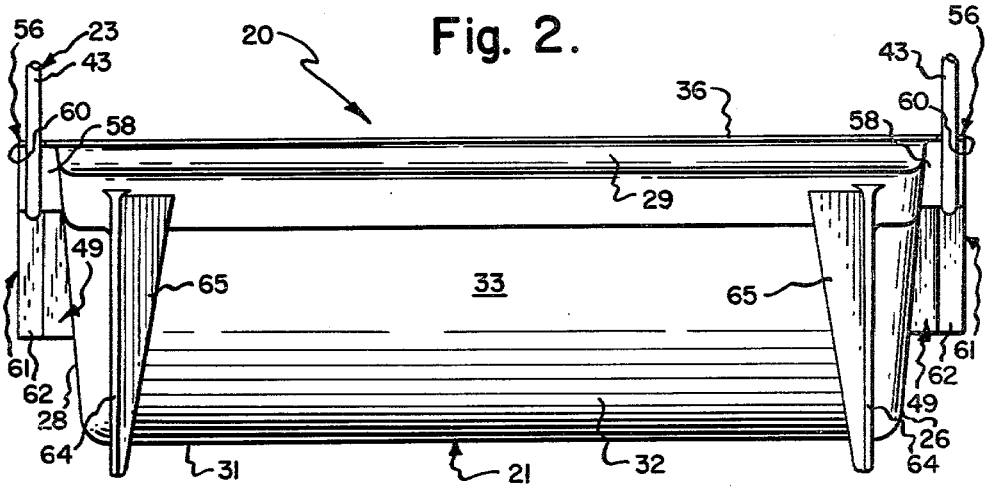
FIG. 2 is a fragmentary front elevation thereof.
Figure 3:
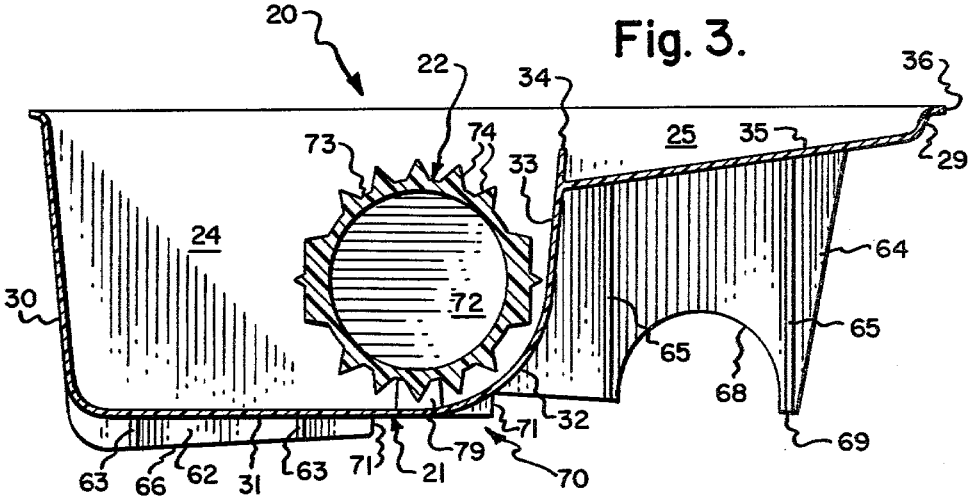
FIG. 3 is a fragmentary vertical sectional view thereof, taken generally on line 3—3 of FIG. 1, and showing the tray and roller in cross-section.

Referring now to FIGS. 1–6, the tray 21 is shown as being a uniquely configured member, preferably formed of a suitable plastic material, such as high density polyethylene or the like. Tray 21 includes a rearward trough portion 24, and a raised upwardly inclined shelf portion 25 extending forwardly therefrom. More specifically, the tray 21 has a pair of spaced horizontally-elongated upwardly and outwardly inclined left and right side walls 26, 28, and a pair of upwardly and outwardly inclined front and rear walls 29, 30. In the preferred embodiment, walls 26–30 are inclined outwardly with respect to the vertical at an acute included angle on the order of about five degrees, although this exact angle is not deemed critical and need not invariably obtain. As best shown in FIGS. 2 and 3, the bottom 31 of the trough portion 24 is shown as arcuately joining the left, right and rear walls 26, 28, 30, and as tangentially joining a lower arcuate portion 32 of a planar intermediate wall 33 which extends upwardly and forwardly at a like angle of about five degrees to provide an uppermost wiping lip 34 above the bottom 35 of the shelf portion. Of course, this wiping lip 34 provides an edge across which an applicator may be drawn to remove excess paint. The intermediate wall lower arcuate portion 32 is preferably configured as a segment of a cylinder generated about the axis of the trunnion bearings. The shelf portion bottom 35 joins the left and right side walls 26, 28, and extends forwardly and upwardly at an angle of about eight degrees with respect to the horizontal, to join the lower margin of front wall 29. The left right, front and rear tray walls 26, 28, 29, 30 are shown as terminating in an uppermost out-turned permetrical common lip, collectively indicated at 36.

Figure 6:
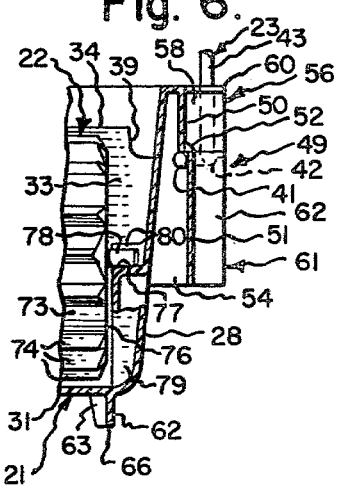
FIG. 6 is a fragmentary vertical sectional view thereof, taken generally on line 6—6 of FIG. 5, and showing the mounting means, the abutment means, a roller stub shaft journalled in the associated trunnion bearing, and also showing a passageway in the intermediate wall.

Referring now to FIGS. 1 and 6, the intermediate wall 33 is shown provided with a pair of left and right passages 38, 39 which extend downwardly from wiping lip 34 adjacent the left and right side walls 26, 28 to join the shelf bottom 35. Moreover, the shelf bottom 35 is provided with a plurality of rearwardly and laterally inclined ribs, severally indicated at 40, which function to direct a flow of paint or the like on the shelf, toward the passages 38, 39 so that it may flow back into the trough portion 24.

Figure 7:
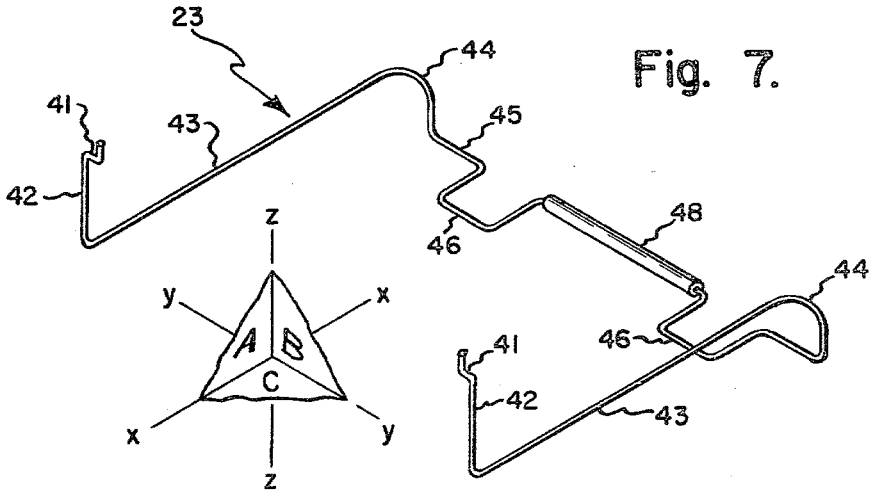
FIG. 7 is a perspective view of the bail, and further showing, as a frame of reference, three mutually perpendicular planes and lines of intersection therebetween.

Referring now to FIG. 7, the bail 23 is shown as being a uniquely-configured wire-form member. The bail will be described with reference to three mutually perpendicular planes A, B and C, which intersect to define three mutually perpendicular lines x—x, y—y and z—z, as schematically indicated in FIG. 7. Bail 23 is shown as having two hooked marginal end portions 41, 41, arm portions 42, 42, leg portions 43, 43, arcuate transitional portions 44, 44, and a common cross-bar 45 provided with two U-shaped hook portions 46, 46. The central portion of the cross-bar is surrounded by a tubular sleeve 48 which provides a carrying handle and which may conceal a butt weld between two separate wire sections, if this construction is employed. The bail is bent between the various portions above described.

The hooked end portions 41, 41 and the arm portions 42, 42 are all elongated in a common plane parallel to plane B. The arm portions 42, 42 extend away from the hooked end portions 41, 41 along lines parallel to line z—z. The leg portions 43, 43 extend away from the arm portions along lines parallel to line x—x. The arcuate transitional portions extend away from the leg portions 43, 43 in planes parallel to plane A. The entire cross-bar 45 including hook portions 46, 46 is arranged in a plane parallel to plane C. Hence, cross bar 45 lies in a plane which is spaced from, but preferably substantially parallel to, a plane including leg portions 43, 43.

Referring now to FIGS. 1, 2 and 4–6, mounting means, severally indicated at 49, are shown as being mounted on each side wall proximate the trough portion 24 and rearwardly of the tray's center of gravity. As best shown in FIG. 6, each mounting means 49 includes an outer wall depending from the outward margin of outturned flange 36 so as to be spaced from the adjacent tray side wall. Specifically, each such outer wall includes a rectangular vertical upper portion 50, and a rectangular vertical lower portion 51 lapped on upper wall portion 50 and bonded thereto at 52. Each outer wall portion 51 is provided with an opening 53 proximate bond 52 to receive one of the bail hooked end portions 41. Moreover, each outer wall is strengthened by fore and aft walls 54, 55 extending outwardly from the adjacent side wall to join the outer wall. Hence, each mounting means 49 is mounted on a side wall to provide an opening, such as opening 53, spaced laterally from the tray's center of gravity, to receive insertion of one of the bail hooked end portions. While this construction is preferred, it should be appreciated that the form of the mounting means is not limited to that shown and described. Other forms of such mounting means might also provide a wall spaced from the adjacent side wall. Alternatively, in a simplified construction, the mounting means might simply be a hole provided through the side wall itself. At any rate, the function of the mounting means, in whatever structural form it may take, is to provide an opening spaced laterally from the tray's center of gravity.

Figure 11:
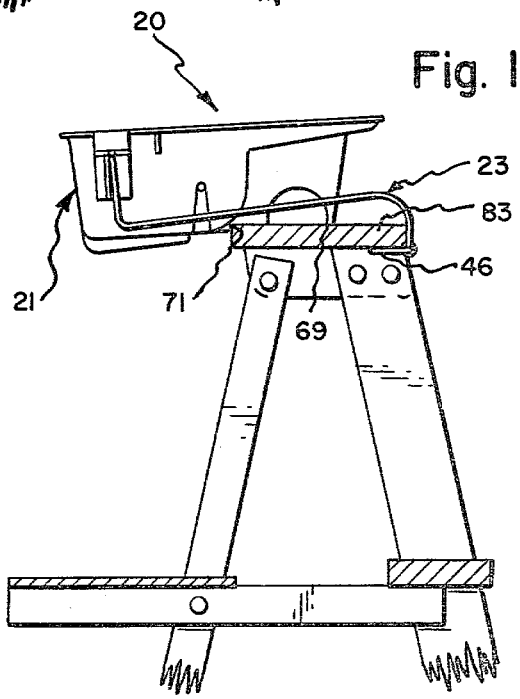
FIG. 11 is a right side elevation of the tray assembly mounted on the top rung of a step ladder, again with the bail proximate its lowered position.

Thus, the bail is adapted to be pivotally mounted on the tray for movement in one angular direction (i.e., counterclockwise in FIG. 9) toward a raised position (FIG. 9), and for movement in the opposite angular direction (i.e., clockwise in FIG. 9) toward a lowered position (as closely approached in FIG. 11).

The improved tray is shown as further including stop means, generally indicated at 56, and arranged to engage a portion of the bail when the bail is in the raised position to prevent further counterclockwise pivotal movement of the bail relative to the tray. As best shown in FIGS. 1, 2 and 6, each stop means 56 may simply include a vertical plate-like member 58 extending outwardly from the adjacent side wall and provided with a notch or recess or extending upwardly from its lower edge to receive the arm portion of the bail. In the preferred embodiment, the upper edge of plate 58 is further secured to a tab 60 extending outwardly from perimetrical flange 36.

The preferred embodiment is also shown as including abutment means, generally indicated at 61, mounted on the tray and adapted to engage the bail when the bail is in the lowered position (not completely shown) to prevent further pivotal clockwise movement of the bail relative to the tray. This abutment means 61 may simply include a vertical plate-like member 62 extending laterally outwardly from mounting means plate portion 51 and adapted to engage the bail arm portion. The abutment means 61 functions to prevent the bail from hanging down beneath the tray if the tray is grasped and lifted. Were such abutment means not provided, the depending bail might interfere with a user's subsequent placement of the tray on a suitable object, such as a table or floor.

Adverting now to FIGS. 2 and 3, the preferred form of tray 21 is further shown as provided with a pair of laterally-spaced rearward skid-like members, severally indicated at 62, reinforced by gusset plates 63, 63 and provided with a pair of laterally-spaced plate-like supports severally indicated at 64, similarly reinforced by gusset plates 65, 65. As best shown in FIG. 3, each rearward skid-like member 62, 62 is mounted on the tray bottom 31 and has a lower surface 66 inclined forwardly and upwardly at an acute included angle of about three degrees so that when the tray rests on a suitable horizontal planar support, trough portion bottom 31 will be slightly inclined to cause paint to flow towards roller 22.

Each forward support 64 has a semi-cylindrical recess 68 extending upwardly from its lower surface, and has a forwardmost foot portion 69 aligned with skid lower surface 66.

Moreover, the improved tray is preferably provided with tooth means, generally indicated at 70, arranged on the tray bottom and defining at least one, and preferably more, stepped notches 71, 71 arranged to face toward the cross-bar 45 when the bail is in its lowered position, for a purpose hereinafter explained.

Figure 4:
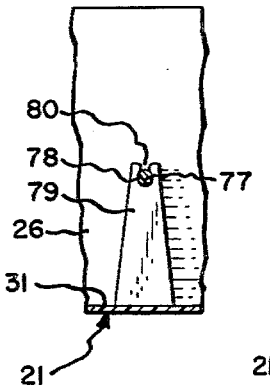
FIG. 4 is a fragmentary vertical sectional view thereof, taken generally on line 4—4 of FIG. 1, and showing a trunnion support in elevation.
Figure 5:
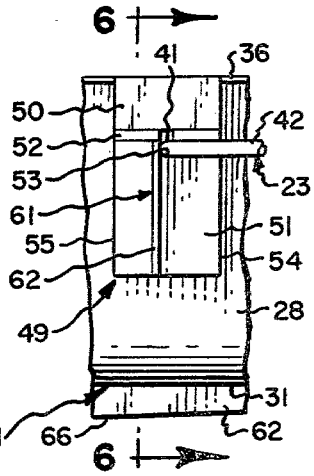
FIG. 5 is a fragmentary vertical sectional view thereof, taken generally on line 5—5 of FIG. 1, and showing the right side mounting means and the abutment means extending outwardly therefrom.

Referring now to FIGS. 1, 3 and 4, the optional roller 22 is shown as being a hollow blow-molded plastic member having a sealed chamber 72 therewithin. Roller 22 has an outer cylindrical surface 73 from which a plurality of axially-elongated circumferential-spaced ribs 74 extend outwardly. The particular configuration of the roller ribs is illustrative only and is designed to facilitate ease in separation of the roller from the mold halves after formation. This roller 22 also has annular vertical left and right end faces 75, 76. A stub shaft 78 extends axially beyond each roller end face and is shown as having a convex or rounded distal end portion to minimize frictional contact with the trunnion bearings, severally indicated at 79.

As best shown in FIG. 4, each trunnion bearing 79 includes a support mounted on the adjacent side wall and extending upwardly from the tray bottom. An upwardly-opening generally C-shaped recess extends downwardly into the support 79 from its upper horizontal surface. Specifically, each such trunnion bearing recess includes an uppermost narrowed entrance portion 80 having a width slightly less than the diameter of the associated stub shaft, and leading downwardly to larger substantially cylindrical recess 77, which is slightly larger in diameter than the diameter of the associated stub shaft. Hence, the roller may be initially positioned such that its stub shafts are arranged above the trunnion bearings, and then pressed downwardly to snap the stub shafts through narrowed entrance portions 80 to enter the cylindrical recess therebelow. This arrangement serves to prevent unintended separation of the roller from its trunnion bearings, as might otherwise occur, for example, if the roller were to float on a quantity of paint in trough portion 24.

One unique advantage of the improved tray assembly lies in the universality of its application and use, as depicted in several environments shown in FIGS. 8–13.

Figure 8:
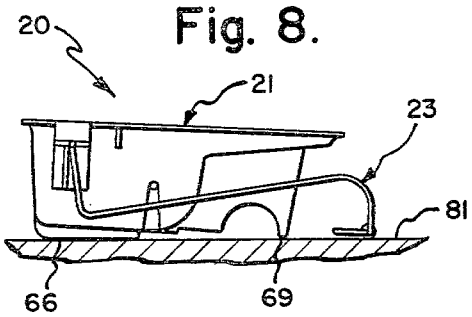
FIG. 8 is a right side elevation showing the improved tray assembly resting on a suitable horizontal planar support, with the bail proximate its lowered position.

In FIG. 8, the tray assembly is shown as resting on a suitable horizontal planar surface 81, such as a table, platform or floor. In this position, the lower surfaces of the rearward skid-like members and the foot of the forward support will rest on the surface so that the trough portion bottom will be slightly forwardly and downwardly inclined, causing paint in the trough to flow toward the roller. In this position, the bail cross-bar will also rest on the support, just short of its fully lowered position.

Figure 9:
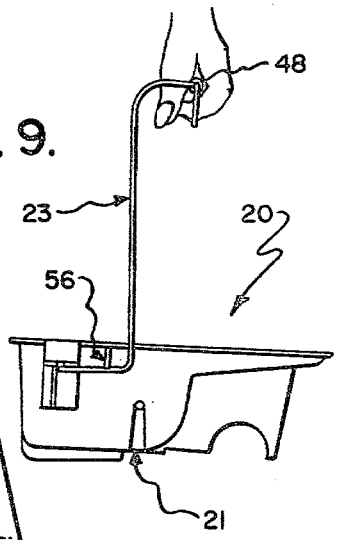
FIG. 9 is a right side elevation of the tray assembly, with an operator holding the bail in its raised position.

Alternatively, the bail may be moved to its raised position so that the tray may be carried, as shown in FIG. 9. Here, the location of the bail's pivotal axis, coupled with the engagement between the stop means and the bail arm portion, insures the stability of the depending tray regardless of the quantity of paint in trough portion 24.

Figure 10:
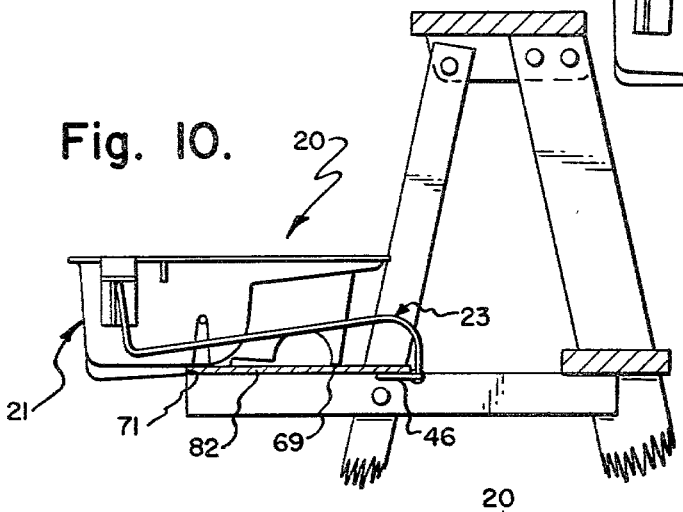
FIG. 10 is a right side elevation of the tray assembly mounted on the shelf of a step ladder, with the bail proximate its lowered position.

The improved tray assembly may also be mounted on the shelf 82 or top step of a step ladder, as shown in FIGS. 10 and 11, respectively. In FIG. 10, the bail cross-bar hook portions 46, 46 are shown as arranged beneath one end of the shelf, with the shelf's other end being received in the appropriate notch of the tooth means. In FIG. 10, it will be appreciated that the tray abutment means will limit further substantial counter-clockwise pivotal movement of the tray relative to the shelf.

The application of the tray assembly to the top step of the step-ladder, as shown in FIG. 11, is similar, except that the top step is shown as engaging a different notch of the tooth means to allow for dimensional variation between the width of the shelf and top step.

Figure 12:
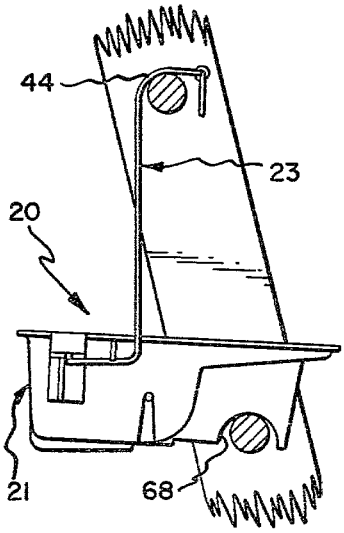
FIG. 12 is a right side elevation of the tray assembly mounted on a ladder, with the raised bail engaging one rung, and the support recess engaging the next lower rung to provide a measure of fore and aft stability.

As shown in FIG. 12, the tray assembly may also be mounted on a ladder such that the bail, in its raised position, will have its hook portions engaging one rung, with the support recess engaging the next lower rung. This is desirable since it affords the tray with a measure of fore and aft stability, particularly when the painter draws his applicator across wiping edge 34.

Of course, the invention contemplates that various modifications and changes may be made. While it is presently preferred to form the tray integrally, such construction need not invariably obtain, and the various component tray parts may be formed as separate units subsequently assembled together. While the disclosed tray assembly is shown as including a roller journalled on trunnion bearings, it should be clearly understood that this roller member is optional and may be omitted, if desired.

Therefore, while the presently preferred embodiment of the improved tray assembly has been shown and described, persons skilled in this art will readily appreciate that various additional changes and modifications may be made without departing from the spirit of the invention as defined in the following claims.

What is claimed is:

1. A tray assembly, comprising:

a tray having a bottom and a pair of spaced side walls;

mounting means on each of said side walls and severally providing an opening spaced laterally from the center of gravity of said tray;

a bail pivotally mounted on said tray for movement in one angular direction toward a raised position and for movement in the opposite angular direction toward a lowered position, said bail having two marginal end portions inserted into said mounting means openings, an arm portion extending away from each marginal end portion, and a leg portion extending away from each arm portion, said arm portions being arranged in a first plane and said leg portions being arranged in a second plane arranged substantially perpendicular to said first plane;

stop means mounted on said tray and arranged to engage said arm portions when said bail is in said raised position to prevent further pivotal movement of said bail relative to said tray in said one angular direction; and abutment means mounted on said tray and arranged to engage said arm portions when said bail is in said lowered position to prevent further pivotal movement of said bail relative to said tray in said opposite angular direction.

2. A tray assembly as set forth in claim 1 wherein said bail includes a cross-bar joining said leg portions and arranged in a third plane spaced from said second plane.

3. A tray assembly as set forth in claim 2 wherein said cross-bar includes a hook portion arranged in said third plane.

4. A tray assembly as set forth in claim 3 and further comprising tooth means on said tray bottom providing a notch arranged to face toward said cross-bar when said bail is in said lowered position.

5. A tray assembly as set forth in claim 3 wherein said bail hook portion is adapted to be hung on the rung of a ladder, and wherein said tray is provided with a recess adapted to engage the next lower rung of said ladder.

6. A tray assembly as set forth in claim 1 and further comprising:

a pair of trunnion bearings mounted on said side walls and arranged to face one another; and a roller having an outer surface, opposite end faces, and a stub shaft extending axially beyond each end face, said stub shafts being received in said trunnion bearings.

7. A tray assembly as set forth in claim 6 wherein the distal ends of said stub shafts are convex.

8. A tray assembly as set forth in claim 7 wherein each of said trunnion bearings has an upwardly-opening generally C-shaped cross-section including a narrowed entrance portion leading downwardly into a cylindrically-segmented recess.

9. A tray assembly as set forth in claim 8 wherein the width of each of said narrowed entrance portions is less than the diameter of said associated stub shaft such that said stub shafts may be snapped through said narrowed entrance portion to enter said recess.

* * * * *